United States Patent [19]

Boudville

[11] Patent Number: 4,615,350

[45] Date of Patent: Oct. 7, 1986

[54] COIN DISPENSING DEVICES

[75] Inventor: Glenn H. Boudville, Casula, Australia

[73] Assignee: Ainsworth Nominees Pty. Ltd., New South Wales, Australia

[21] Appl. No.: 610,506

[22] Filed: May 15, 1984

[30] Foreign Application Priority Data

May 24, 1983 [AU] Australia ..... PF9504

[51] Int. Cl.[4] ..... G07D 1/00

[52] U.S. Cl. ..... 133/1 R

[58] Field of Search ..... 133/1 R, 3 R, 3 A, 3 H, 133/5 R, 8 R, 8 A

[56] References Cited

U.S. PATENT DOCUMENTS 3,396,737 8/1968 Picollo ..... 133/8 R X

*Primary Examiner*—F. J. Bartuska

*Attorney, Agent, or Firm*—Murray and Whisenhunt

[57] ABSTRACT

A coin dispensing device having a resiliently biased ejector member opposite a coin runner. The ejector member being adapted to interact with a coin attempting to pass out of the device along the runner when that coin is not positioned to pass beneath the runner. The coin moving the ejector member against its biasing force as the coin is drawn along the runner but being influenced by the ejector member to fall off the coin runner back into a housing forming part of a coin storage bowl.

1 Claim, 5 Drawing Figures

COIN DISPENSING DEVICES

The present invention relates to coin dispensing devices of the disc type. Such devices are used for dispensing coins in a variety of coin handling machines and in particular in poker machines (also known as slot machines or fruit machines) and in the trade in such machines these devices are known as hoppers.

Coin dispensing devices of the disc type usually consist of a disc driven by an electric motor and arranged to rotate in an inclined bowl. Circumferentially spaced on the surface of the disc are small pegs or functionally equivalent structures arranged to entrain a coin lying against the face of the disc between a pair of adjacent pegs and carry the coins around to a tangentially arranged runner along which the coins are caused to leave the device. Concentric with the coin driving disc is a smaller disc called a spigot which is arranged to lie against the surface of the disc and which is of a thickness equal to or slightly less than the thickness of a coin with which the dispensing device is intended to operate. By reason of the limited thickness of the spigot the disc will pick up one layer of coins only allowing any second layer to fall back into the bowl. The disc is fed by a mass of coins lying in the bowl and urged by gravity towards the disc. Such a coin dispensing device is referred to hereinafter as a coin dispensing device of the kind set forth.

Coin dispensing devices of the kind set forth are constructed so that the thickness of the spigot is usually somewhat less than the coin thickness so that only one layer of coins is carried up on the disc, any second layer being unsupported, falls back into the bowl. There are rare occasions however when the mass of coins in the working area of the bowl is great and acts to prevent the second layer of coins falling away freely. Under these conditions extra coins can escape from the hopper resulting in the dispensing of more coins than was intended. To prevent this it has been proposed to place a barrier at a height a little above coin width to allow only a single layer of coins resting against the disc to pass under the barrier. Such a barrier has however the disadvantage that any coin on the disc with its trailing edge sitting on the top of a coin driving peg would jamb beneath the barrier, creating a situation worse than the dispensing, occasionally, of an extra coin. For this reason barriers in the form of a leaf spring have been provided in the past. These however have not proved completely successful.

The present invention consists in a coin dispensing device of the disc type having a disc rotated by an electric motor, the disc being arranged to rotate in a housing constituting part of a coin storage bowl, a plurality of circumferentially spaced pegs or functionally equivalent structures on the face of the disc arranged to entrain coins in said bowl lying against the face of the disc between adjacent pegs as the disc rotates, a central concentric spigot on the face of the disc of a thickness equal to or slightly less than the thickness of a coin with which the dispensing device is intended to operate arranged to support coin carried between said pegs and a coin runner arranged tangentially to the periphery of the spigot onto which coins carried between said pegs on the spigot are delivered characterised in that a coin ejecting device is arranged in close proximity to the coin runner the device consisting of a member pivotally attached to the casing of the hopper, the member having a flat surface arranged parallel to the surface of the disc and spaced therefrom at a distance such that a single layer of coins may pass freely between it and the disc, to the coin runner, the member having on a face opposite said surface an inclined surface such that the member presents a fine edge towards oncoming coins, the arrangement being such that a second layer of coins carried by the disc to the member is caused either to fall back into the hopper by said inclined surface or, if propelled by a peg and in contact with said fine edge to act to pivot said member in such a manner that the coin while being allowed to pass onto the coin runner is influenced by the member to fall off the coin runner back into the hopper.

In order that the nature of the invention may be better understood a preferred form thereof is hereinafter described, by way of example, with reference to the accompanying drawings in which.

Figure 1:
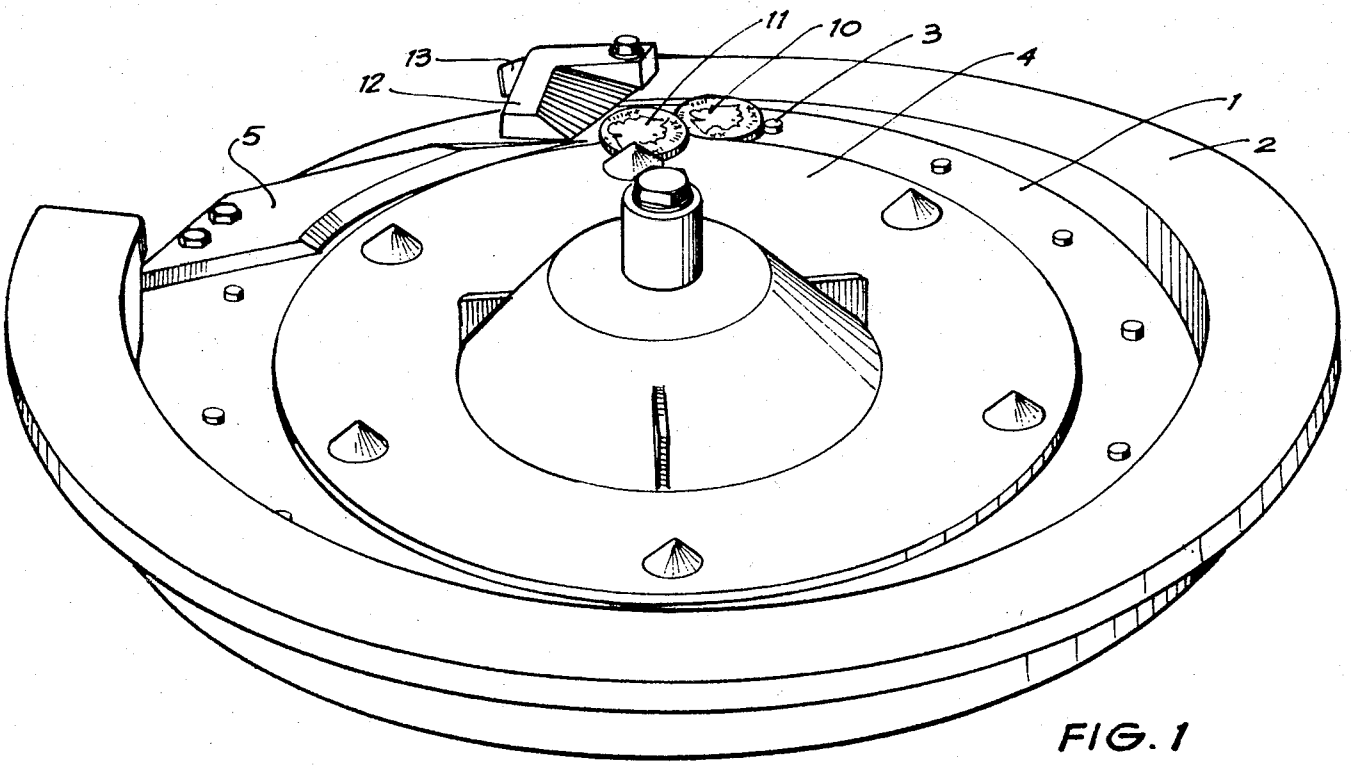
FIG. 1 is a perspective view of the hopper with the extension bowl removed.
Figure 2:
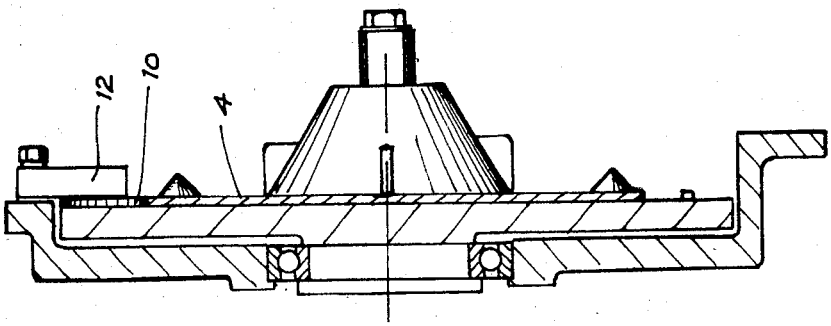
FIG. 2 is a cross sectional view of the hopper of FIG. 1 through the centre thereof.

FIG. 1 shows a hopper for a poker machine. To this is normally attached an extension bowl having a sloping floor which contains a mass of coins urged by gravity into contact with the disc 1 of the coin dispenser which is mounted for rotation in a housing 2 on a suitable ball bearing and is driven by an electric motor at the back of the casing 2. Coins for dispensing from the hopper are picked up between the driving pegs 3 that are spaced circumferentially around the disc 1 being spaced apart so that a single coin that lies flat against the face of the disc can be picked up between any pair of pegs. Normally coins such as 10 are carried around on the spigot 4 until the coin runner 5 is reached whereupon they are transferred to the upper tangential surface of the runner 5 and are dispensed from the hopper. However, as illustrated in FIG. 1 a second layer of coins can form against the coins such as 10 on the surface of the disc. A single coin 11 is shown. It must be appreciated however that the whole area in front of the disc is a mass of coins in a random arrangement.

Figure 3:
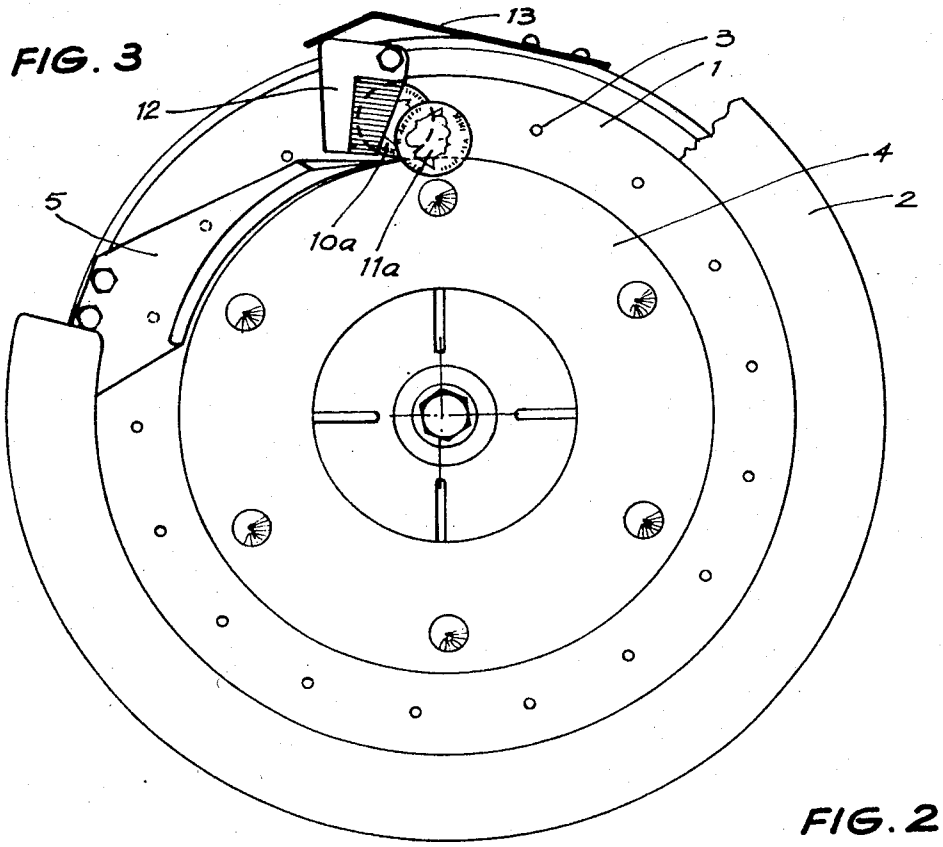
FIG. 3 is a front elevation of the hopper illustrating the action of the ejector device in deflecting a second layer of coins where the coins are not under the influence of a driving peg.
Figure 5:
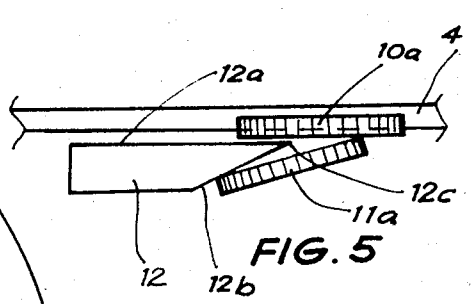
FIG. 5 illustrates the action of a diverter member in the circumstances illustrated in FIG. 3.

Immediately before the coin runner 5 is mounted a diverter member 12 which is attached pivotally to the casing 2 and is maintained in the position shown in FIG. 1 under normal circumstances by a leaf spring 13. The ejector member 12 has a plane surface 12*a* arranged parallel to the surface of the disc and at a distance from it such that a coin 10*a* of FIG. 5 can pass between the disc and the surface 12*a*. The ejector member 12 has on the opposite side to the face 12*a* an inclined face 12*b* which meets the face 12*a* at an acute angle to present a knife edge 12*c* to approaching coins. The effect of this under one set of circumstances is illustrated in FIGS. 3 and 5 in which the second layer of coins, a typical one of which is represented by coin 11*a*, is not being forced against the diverter 12 by one of the pegs 3. In this case the coin 11*a* is merely diverted by the face 12*b* as illustrated in FIG. 5 and caused to fall back into the hopper.

Figure 4:
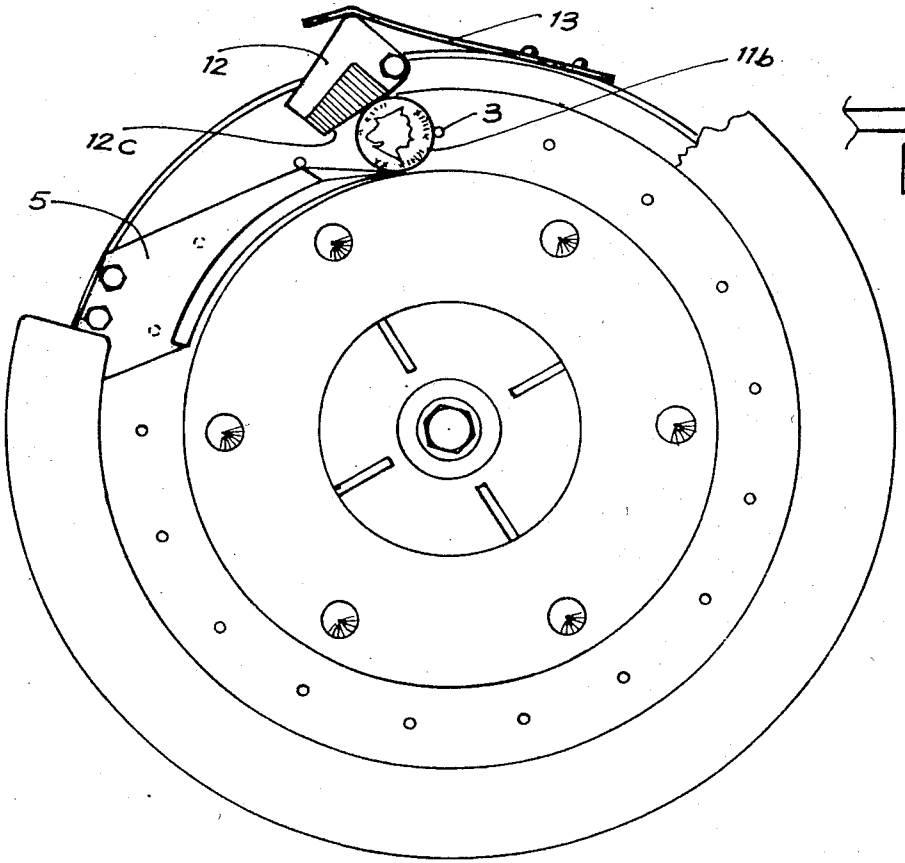
FIG. 4 is a similar view to FIG. 3 illustrating the action of the diverter on a coin that is under the driving influence of a peg.

If on the other hand, as illustrated in FIG. 4 the coin 11*b* which is exactly overlying a coin 10*b* (not visible) on the face of the disc is propelled by a peg 3 and forced up against the knife edge 12*c*, the diverter 12 is caused to pivot against the spring 13 as illustrated in FIG. 4 and the coin 11*b* is jambed between the edge 12*c* and the top of the coin runner 5 while being continually urged forward by the peg 3. Observations have shown that in these circumstances the coin 11*b* passes onto the runner 5 in an unstable condition and falls back into the hopper. The reason for this is not fully understood but it appears to be due to the fact that friction at the top of the coin is greater than at the bottom and the coin is reluctantly pushed by the peg 3 and is caused to turn anticlockwise in the process as it skids along the runner, this anticlockwise turning causing an instability of the coin which results in its falling back into the hopper.

The embodiment of the invention described above is given by way of example only as constituting a preferred form of the invention as defined broadly in the succeeding claims.

I claim:

1. A coin dispensing device of the disc type having a disc rotated by an electric motor, the disc being disposed in a first plane and arranged to rotate in said first plane in a housing constituting part of a coin storage bowl, a plurality of circumferentially spaced pegs or functionally equivalent structures on the face of the disc arranged to entrain coins in said bowl lying against the face of the disc between adjacent pegs as the disc rotates, a central concentric spigot on the face of the disc of a thickness equal to or slightly less than the thickness of a coin with which the dispensing device is intended to operate arranged to support coins carried between said pegs and a coin runner arranged tangentially to the periphery of the spigot onto which coins carried between said pegs on the spigot are delivered characterized in that a coin ejecting device is arranged in close proximity to the coin runner, the device consisting of a member disposed in a second plane which is spaced apart from and parallel to said first plane, said member being pivotally attached to the casing of the hopper for pivotal movement relative to the casing in said second plane, the member having a flat surface arranged parallel to the surface of the disc and spaced therefrom at a distance such that a single layer of coins may pass freely between it and the disc, to the coin runner, the member having on a face opposite said surface an inclined surface such that the member presents a knife edge towards oncoming coins, the arrangement being such that a second layer of coins carried by the disc to the member is caused either to fall back into the hopper by said inclined surface or, if propelled by a peg and in contact with said knife edge to act to pivot said member in said second plane in such a manner that the coin while being allowed to pass onto the coin runner is influenced by the member to fall off the coin runner back into the hopper.

* * * * *